US009258867B2

(12) United States Patent
Liu et al.

(10) Patent No.: US 9,258,867 B2
(45) Date of Patent: Feb. 9, 2016

(54) LIGHT EMITTING APPARATUS AND METHOD OF OPERATING THEREOF

(71) Applicant: Epistar Corporation, Hsinchu (TW)

(72) Inventors: Hsin-Mao Liu, Hsinchu (TW); Zong-Xi Chen, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 497 days.

(21) Appl. No.: 13/680,342

(22) Filed: Nov. 19, 2012

(65) Prior Publication Data

US 2014/0139138 A1 May 22, 2014

(51) Int. Cl.
*H05B 37/02* (2006.01)
*H05B 33/08* (2006.01)

(52) U.S. Cl.
CPC ..... *H05B 33/0872* (2013.01); *H05B 33/0866* (2013.01)

(58) Field of Classification Search
CPC ..... H05B 33/0818; H05B 33/086; H05B 33/0866; H05B 33/0872
See application file for complete search history.

(56) References Cited

U.S. PATENT DOCUMENTS

2006/0237636 A1* 10/2006 Lyons ..... F21K 9/00 250/228
2009/0040674 A1* 2/2009 Roberts ..... G09G 3/3406 361/78
2012/0056545 A1* 3/2012 Radermacher ..... H05B 33/0818 315/152

* cited by examiner

*Primary Examiner* — Douglas W Owens
*Assistant Examiner* — Monica C King
(74) *Attorney, Agent, or Firm* — Ditthavong & Steiner, P.C.

(57) ABSTRACT

A light emitting apparatus disclosed herein comprises a first control apparatus, a first light emitting device, a sense apparatus, a second control apparatus, a power source and a second light emitting device, wherein the second light emitting device is electrically connected to the power source which is not connected to the first light emitting device. The sense apparatus senses both temperature and current of the first light emitting device to generate a second driving signal. The second driving signal is then provided to control the second light emitting device to emit a light for compensating the CCT shift of the light emitted by the first light emitting device.

9 Claims, 8 Drawing Sheets

LIGHT EMITTING APPARATUS AND METHOD OF OPERATING THEREOF

TECHNICAL FIELD

This present application relates to a light emitting apparatus, and more particularly to a light emitting apparatus sensing temperature and current variation to compensate the change of color temperature of light and the control method thereof.

BACKGROUND OF THE DISCLOSURE

The light-emitting diodes (LEDs) of the solid-state lighting elements have the characteristics of low heat generation, long operational life, small volume, quick response and the light with a stable wavelength range, so the LEDs have been widely used in various applications. Recently, efforts have been devoted to improve the luminance of the LED in order to apply the device to the lighting domain, and further achieve the goal of energy conservation and carbon reduction. In order to apply LED device to daily life use, such as lighting, various control apparatus are designed for different applications such as luminance controller, light sensor, traffic light controller, automobile lighting, power supply circuit, and so on.

The stability of the light characteristics is also an important issue. Typically, the LED is sensitive to the environmental temperature which means that the higher the ambient temperature, the lower the light emitting efficiency of LED. Take a blue LED and a red LED as examples, as FIG. 1 shows, while the environmental temperature increases from 25° C. to 100° C., the light emitting efficiency of blue LED decreases to 90% and the efficiency of red LED drops to 65%.

In another aspect, the stability of luminance per watt is also an important issue. While dimming function is added into the LED control circuit to change the light intensity by controlling the current density, the change of current density also changes the luminance per watt. Take a blue LED and a red LED as examples, as FIG. 2 shows, while the operating current decreases from 20 mA to about 3 mA, the luminance per watt of blue LED increases from 75% to about 100% and the luminance per watt of red LED also increases from 55% to 90%. Moreover, when the operating current decreases from about 3 mA to 0 mA, the luminance per watt of blue LED increases from 90% to about 100%, but the luminance per watt of red LED decreases from 100% to 90%. While a blue LED and a red LED are put together accompanied with yellow phosphor to emit a predetermined white light, the temperature is increased due to long time use so the light intensity is decreased and the correlated color temperature (CCT) is also changed. Once the operating current of LEDs is changed from 20 mA to 2 mA, the CCT of the white light shifts in an unexpected way.

SUMMARY OF THE DISCLOSURE

The present disclosure provides a light emitting device circuit which comprises a first control apparatus to generate a first driving signal, a first light emitting device emits a first light in response to the first driving signal, a sense apparatus sensing both temperature and current to control a second control apparatus generating a second driving signal, and a second light emitting device emits a second light according to the second driving signal, wherein the second light emitting device is electrically connected to a power source which is not connected to the first light emitting device. The CCT difference between the first light and the second light is less than 300K.

DETAILED DESCRIPTION OF THE PREFERRED EMBODIMENTS

Figure 3:
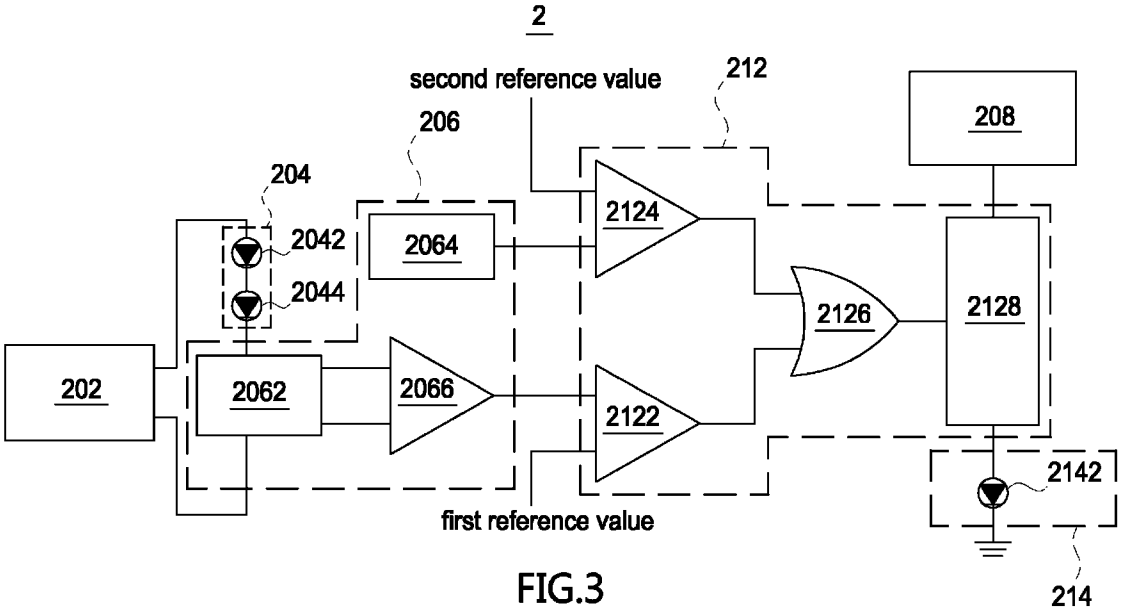
FIG. 3 shows a schematic diagram of an embodiment in accordance with the present disclosure.

FIG. 3 schematically shows an embodiment of the present disclosure. A light emitting apparatus 2 comprises a first control apparatus 202, a first light emitting device 204, a sense apparatus 206, a second control apparatus 212, and a second light emitting device 214 which is connected to a power supply 208. The first control apparatus 202 generates a first driving signal to a first light emitting device 204. The light emitting device 204 emits a first light having a color temperature within a first range. The first light emitting device 204 can also be controlled to emit a first light having a light characteristic such as light intensity, light field distribution, and light emitting period. In another embodiment, the first control apparatus 202 further comprises a tuning function to change the operating current of the first light emitting device 204.

The first light emitting device 204 comprises a first light-emitting diode 2042 emitting a blue light and a second light-emitting diode 2044 emitting a red light. The first light emitting device 204 further comprises a wavelength converting material covering the first light-emitting diode 2042 and the second light-emitting diode 2044. Part of the blue light emitted by the first light-emitting diode 2042 is converted by the wavelength converting material to be a yellow light.

The yellow light is then mixed with the remained blue light to be a white light. The white light is mixed with the red light emitted by the second light-emitting diode 2044 to be a warm white light.

In another embodiment, the wavelength converting material covers the first light-emitting diode 2042 but does not cover the second light-emitting diode 2044. Then, the blue light emitted by the first light-emitting diode 2042 is converted by the wavelength converting material to be a yellow light. The yellow light is also mixed with the blue light to be a white light. Thus a warm white light is then realized by a white light emitted by the first light-emitting diode 2042 and a red light emitted by the second light-emitting diode 2044.

A sense apparatus 206 electrically connected to the first light emitting device 204 comprises a first sense unit 2062 to sense the current passing through the first light emitting device 204 and a second sense unit 2064 to sense the temperature of the light emitting apparatus 2. The first sense unit

2062 senses the operating current of the first light emitting device 204 to generate a first sense signal, and the second sense unit 2064 senses the temperature of the light emitting apparatus 2 to generate a second sense signal. The sense apparatus 206 further comprises an amplifier 2066 electrically connected to the first sense unit 2062 to enlarge the amplitude of the first sense signal. In another embodiment, the second sense unit 2064 further comprises an amplifier to enlarge the amplitude of the second sense signal.

The first sense signal and the second sense signal are further provided to the second control apparatus 212 to generate a second driving signal. The second control apparatus 212 comprises a first comparator 2122 connected to the amplifier 2066 to compare the first sense signal with a first reference value and a second comparator 2124 to compare the second sense signal with a second reference value. The first reference value and the second reference value can be fixed values or variable values. The second control apparatus 212 further comprises an OR gate 2126 to receive the comparison results provided by the first comparator 2122 and the second comparator 2124 and then generates the second driving signal according to the comparison results. The second driving signal is then provided to the switch 2128 to control the second light emitting device 214.

A second light emitting device 214 which comprises a light-emitting diode 2142 is further provided in the embodiment to emit a second light by turning on the switch 2128. The switch 2128 is electrically connected to the power supply 208 and the second light emitting device 214 wherein the power supply 208 is not connected to the first light emitting device 204. The second light emitting device 214 is controlled by turning on/off the switch 2128. The power supply 208 connects to the second light emitting device 214 to avoid the inrush current damaging the second light emitting device 214 and the switches between the second light emitting device 214 and the power supply 208 while operating the first light emitting device 204.

The second light emitting device 214 is controlled to emit a second light when the first sense signal is less than the first reference value or the second sense signal is larger than the second reference value to compensate the CCT shift or other light characteristic changes of the first light. The first light and the second light are then mixed with a color temperature within a second range, and the difference between the first range and the second range is less than 300K. In an embodiment, the mixture of the first light and the second light has a color temperature range of 2500-3000K.

Figure 1:
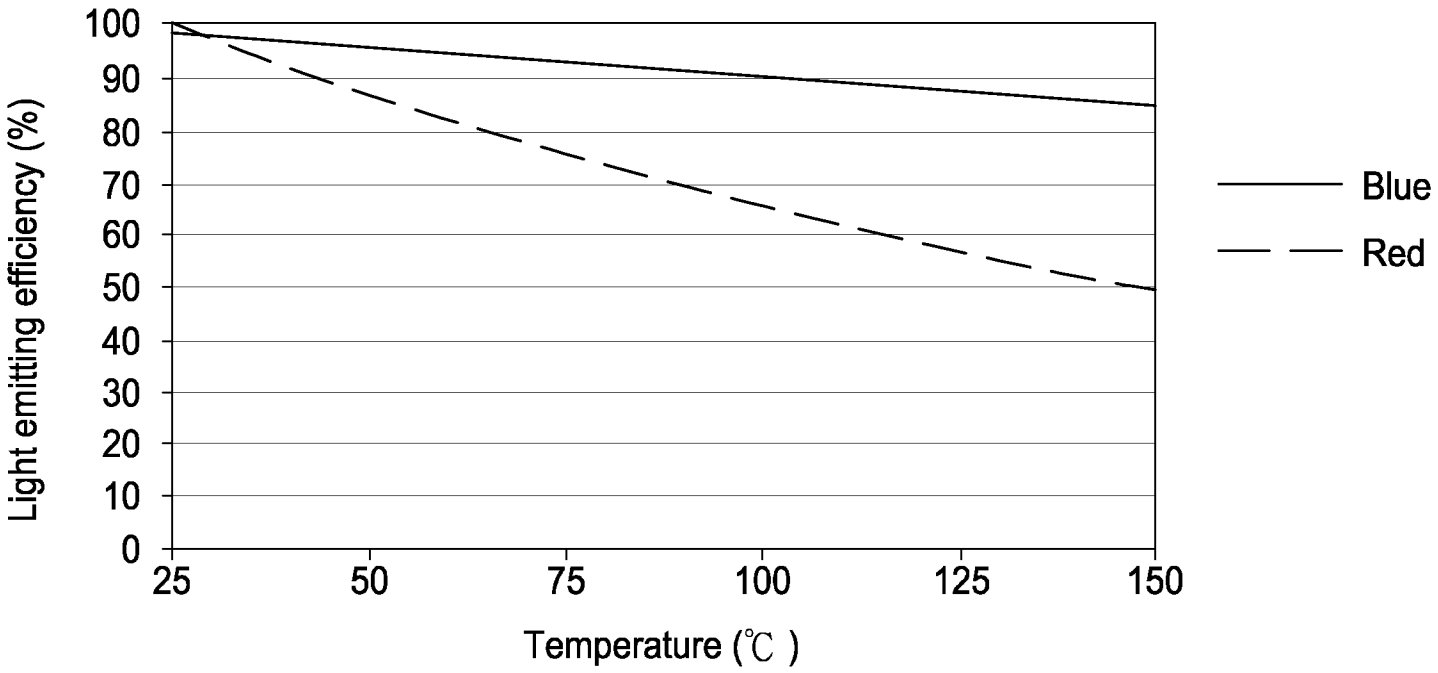
FIG. 1 shows a typical relationship between the temperature and the light emitting efficiency of a blue LED and a red LED.
Figure 2:
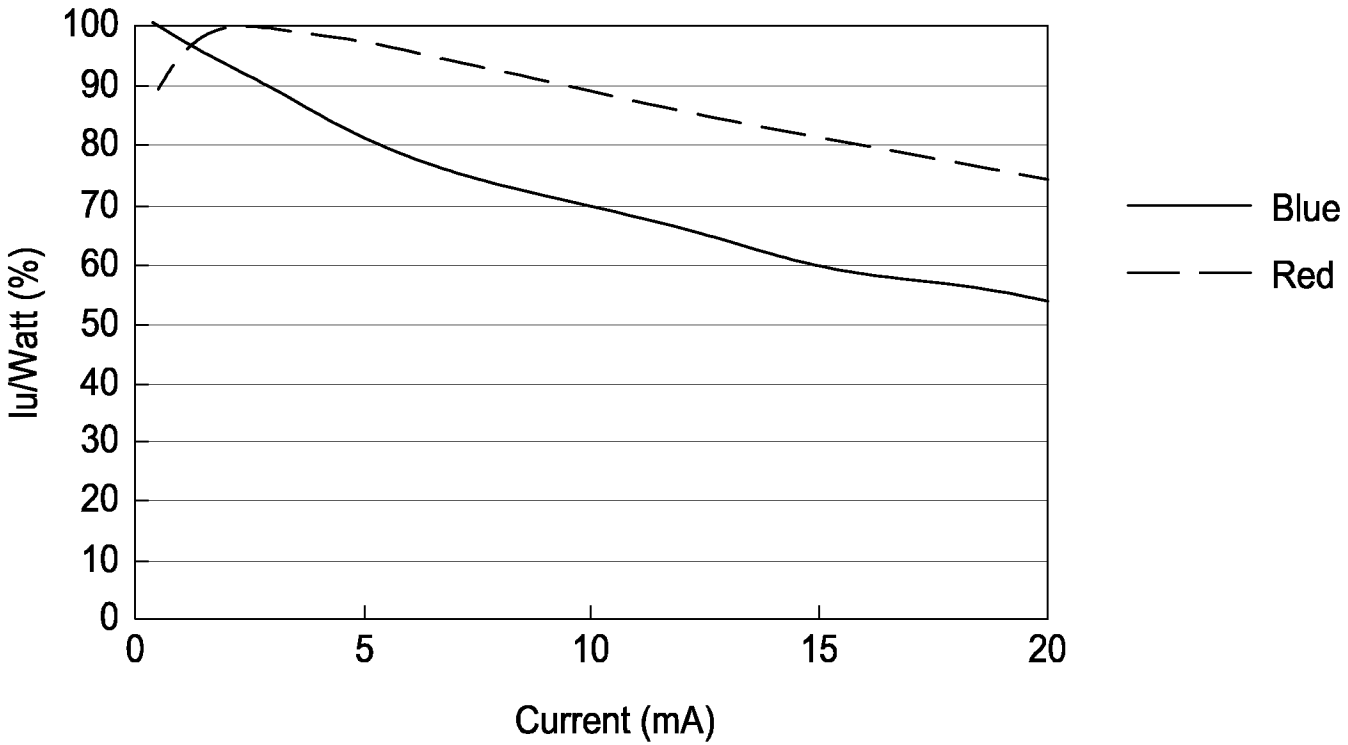
FIG. 2 shows a typical relationship between the operating current and the luminance per watt of a blue LED and a red LED.

The warm white light is generated by the first light emitting device 204 which comprises a second light-emitting diode 2044 emitting a red light and a first light-emitting diode 2042 emitting a blue light. But the light emitting efficiency and luminance per watt of red light-emitting diode and blue light-emitting diode changes while the operating current or the temperature of the light emitting apparatus 2 is changed as described in FIGS. 1 and 2. In other aspect, the CCT of the white light emitted by the first light emitting device 204 changes mainly because the light emitting efficiency and luminance per watt of the red light-emitting diode decreases more than the blue light-emitting diode does. In other cases, the attenuation of light intensity or CCT shift of light can also be resulted from the aging of the first light emitting device 204. To overcome the situation, the sense apparatus 206 controls the second control apparatus 212 to generate a second driving signal provided to the second light emitting device 214 to emit a red light to compensate the CCT shift.

In the embodiment shown in FIG. 3, the second light emitting device 214 and the second light-emitting diode 2044 both emit a red light having a main wavelength ranging from 590-650 nm. The first light-emitting diode 2042 emit a blue light having a main wavelength range from 440-550 nm.

Figure 4:
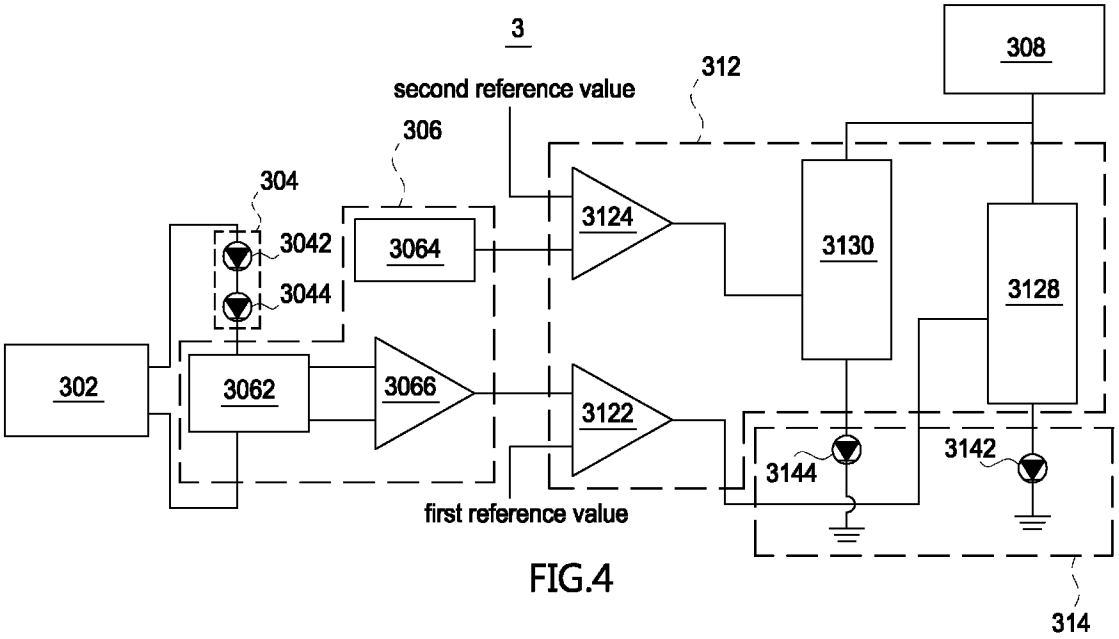
FIG. 4 shows a schematic diagram of an embodiment in accordance with the present disclosure.

FIG. 4 shows a schematic diagram of an embodiment in the present disclosure, a light emitting apparatus 3 comprises a first control apparatus 302, a first light emitting device 304, a sense apparatus 306, a second control apparatus 312, and a second light emitting device 314 which is connected to a power supply 308. The first light emitting device 304 is controlled by the first control apparatus 302 to emit a first light having a color temperature within a first range, and is also connected to the sense apparatus 306 which senses the current passing through the first light emitting device 304 and the temperature of the light emitting apparatus 3. The second light emitting device 314 further comprises a first red light-emitting diode 3142 and a second red light-emitting diode 3144 connected to the power supply 308 which is not connected to the first light emitting device 304. The first red light-emitting diode 3142 and the second red light-emitting diode 3144 are individually controlled by switch 3128 and switch 3130.

The first sense signal and the second sense signal generated by the sense apparatus 306 are provided to the second control apparatus 312 to generate a second driving signal. The second control apparatus 312 comprises a first comparator 3122 connected to the amplifier 3066 to compare the first sense signal generated by the first sense unit 3062 with a first reference value and a second comparator 3124 to compare the second sense signal generated by the second sense unit 3064 with a second reference value. Besides, the first reference value and the second reference value are fixed values or variable. The sense apparatus 306 further generates a second driving signal to control the first red light-emitting diode 3142 and a third driving signal to control the second red light-emitting diode 3144. In other words, the second light emitted by the first red light-emitting diode 3142 and third light emitted by the second red light-emitting diode 3144 compensate the CCT shift or other light characteristic changes of the first light. To be more specific, the first red light-emitting diode 3142 emits the second light when the first sense signal is less than the first reference value and the second red light-emitting diode 3144 emits a third light when the second sense signal is larger than the second reference value.

Each of the mixture of the first light and the second light, the mixture of the first light and the third light, and the mixture of the first light, the second light and the third light has a color temperature within a second range, and the difference between the first range and the second range is less than 300K. Besides, the second range is between 2500-3000K.

The light-emitting diodes in the embodiments such as the first red light-emitting diode 3142, the second red light-emitting diode 3144, and the second light-emitting diode 3044 used in the light emitting apparatus 3 are configured to emit a red light having a main wavelength ranging from 590-650 nm. Besides, the blue light-emitting diode such as first light-emitting diode 3042 used in the light emitting apparatus 3 emits a blue light having a main wavelength ranging from 440-550 nm.

Figure 5:
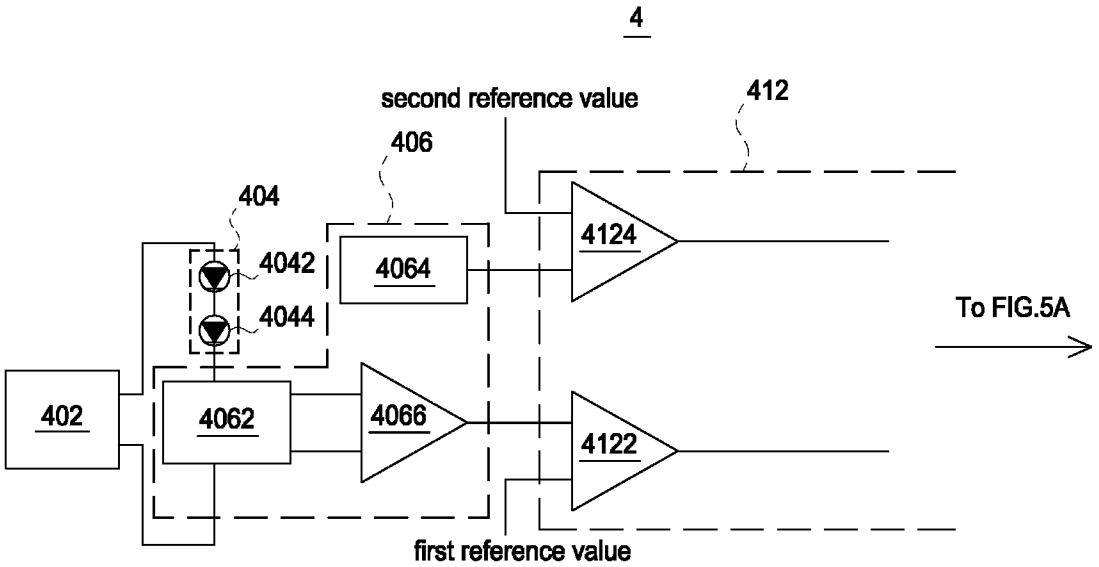
FIGS. 5-5A shows a part of a schematic diagram of an embodiment in accordance with the present disclosure.
Figure 5A:
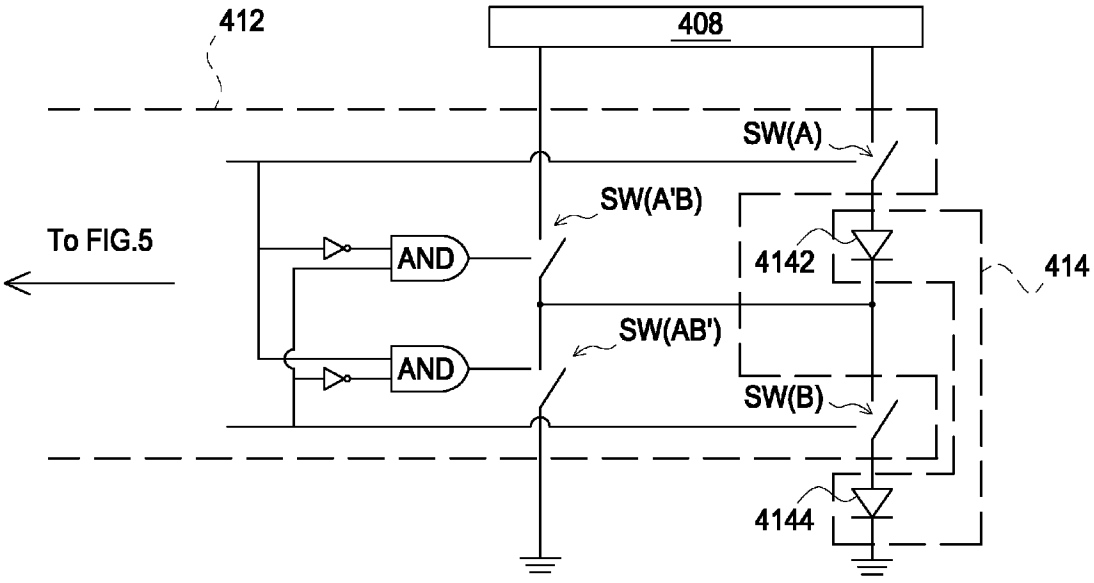

FIGS. 5 and 5A show a schematic diagram of light emitting apparatus 4, wherein the light emitting apparatus 4 has a similar structure with the light emitting apparatus 3 shown in FIG. 4. The first light emitting device 404 is controlled by the first control apparatus 402 to emit a first light having a color temperature within a first range. The first light emitting device 404 is also connected to the sense apparatus 406 which is configured to sense the current passing through the first light emitting device 404 and the temperature of the light emitting apparatus 4. The sense apparatus 406 comprises a first sense unit 4062 to sense the operating current of the first light emitting device 404 generating a first sense signal and a second sense unit 4064 to sense the temperature of the light emitting apparatus 4 generating a second sense signal. The first sense signal and the second sense signal are provided to the control apparatus 412 for generating driving signals. The driving signals are delivered to the switches in the control apparatus 412 to control the second light emitting device 414, which comprises a light-emitting diode 4142 and a light-emitting diode 4144 electrically connected to a power supply 408 in series. The light-emitting diode 4142 and the light-emitting diode 4144 are both red light-emitting diode. The light-emitting diode 4142 and the light-emitting diode 4144 can have different light characteristics such as light intensity, light field distribution, and light emitting period.

To be more specific, the control of the light-emitting diode 4142 and the light-emitting diode 4144 can be implemented by a method of logic operation as depicted in FIG. 5A. In this embodiment, the logic operation comprises two sets of an inverter gate and an AND gate. The light-emitting diode 4142 is turned on by turning on the switch SW(A) and the switch SW(AB'). Wherein the switch is marked with corresponding control logic unit such as the switch SW(A) is turned on while logic A is set to be high. Besides, the logic (A'B) represents a logic combination of an inversion of logic A with a logic B, and the SW(A'B) is set to be high while the logic A is set to be low and B is set to be high. The switch SW(A) is controlled by the output of the comparator 4124 and the switch SW(AB') is controlled by the combinations of the output of the comparator 4122 converted by an inverter gate and the output of the comparator 4124. With the same method, the light-emitting diode 4144 is controlled by the switch SW(B) and the SW(AB'). Moreover, the switch SW(AB') is controlled by the combinations of the output of the comparator 4124 converted by an inverter gate and the output of the comparator 4122. The light-emitting diode 4144 and the light-emitting diode 4142 are controlled individually when the first sense signal is larger than the first reference value or the second sense signal is larger than the second reference value. To be more specific, when the temperature of the light emitting apparatus 4 is too high or the operating current of the first light emitting device 404 is too low, the light-emitting diode 4144 and the light-emitting diode 4142 are turned on and the switches are turned on accordingly. Once the temperature is too high and the current is too low, the light-emitting diode 4144 and the light-emitting diode 4142 are both turned on at the same time wherein the switch SW(A) and the switch SW(B) are turned on but the switch SW(AB') and the switch SW(A'B) are turned off.

Figure 6:
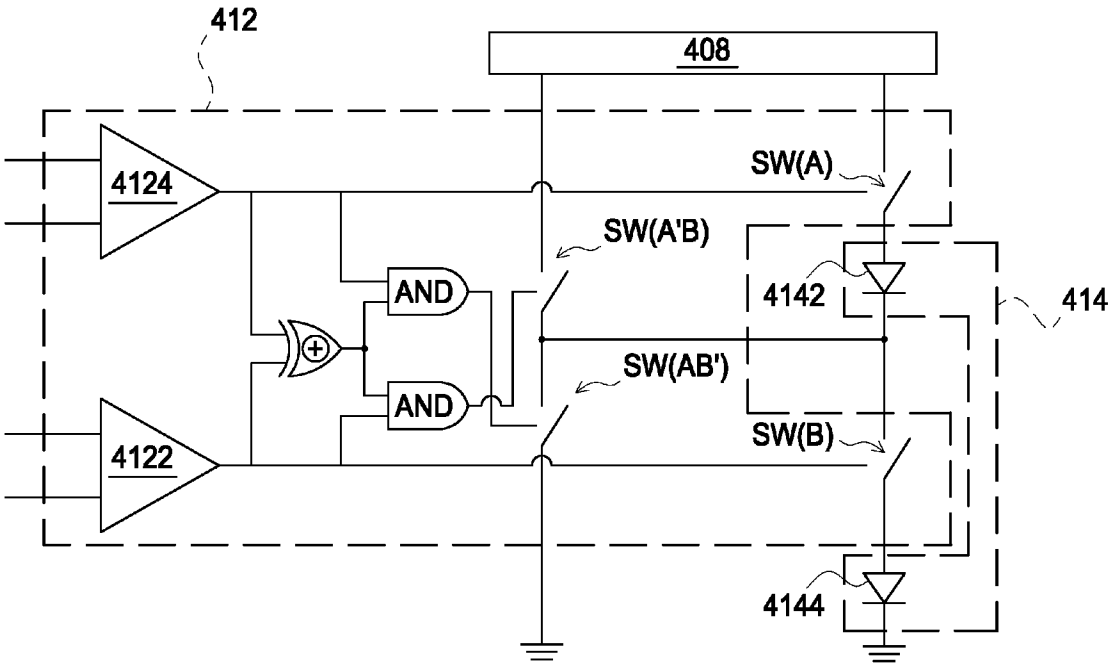
FIG. 6 shows a control apparatus disclosed in an embodiment of the present disclosure.

FIG. 6 shows another embodiment of the control apparatus 412 in FIG. 5 and FIG. 5A. The control of the light-emitting diode 4144 and the light-emitting diode 4142 are implemented by a logic combination of an XOR logic gate and two AND gates. The switch SW(A'B) is implemented by a combination of an output of the XOR gate and the comparator 4122 while the switch SW(AB') is implemented by a combination of an output of the XOR gate and the comparator 4124. The advantage of adopting an XOR gate is less area occupied since there is no extra inverter gate needed to complete the logic operation.

Figure 7:
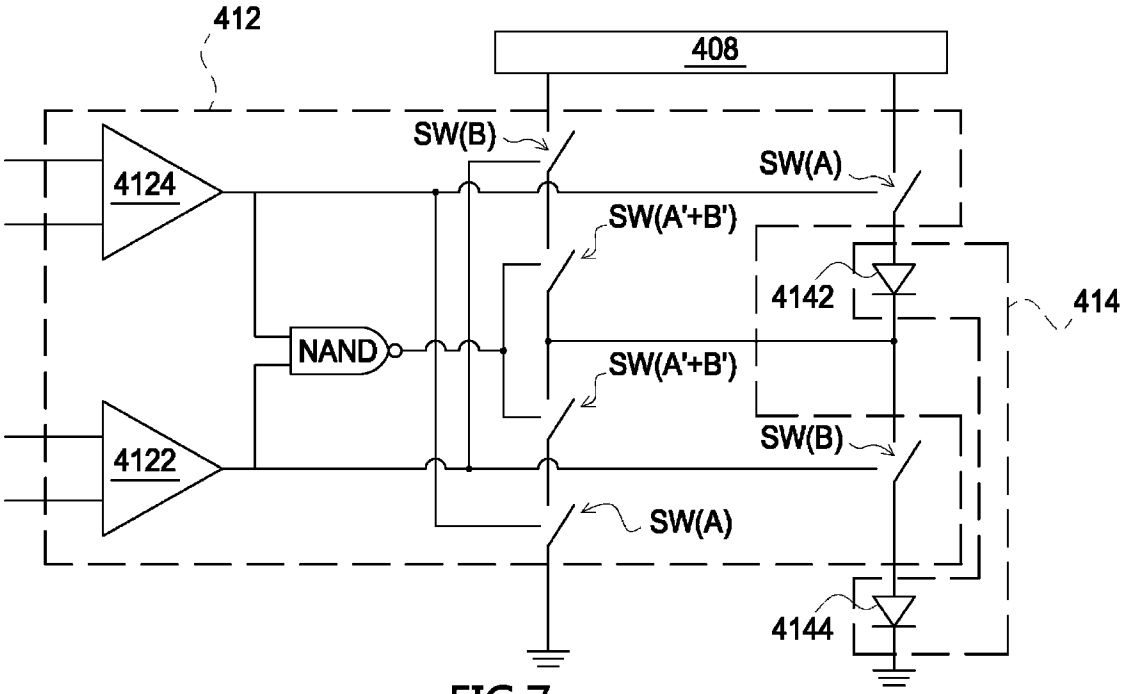
FIG. 7 shows a control apparatus disclosed in an embodiment of the present disclosure.

FIG. 7 shows another embodiment of the control apparatus 412 in FIG. 5 and FIG. 5A. The control is implemented by a NAND gate. When the light-emitting diode 4142 is turned on, the switch SW(A) and the switch SW(A'+B') are turned on and the light-emitting diode 4144 is further controlled by the switch SW(B) and the switch SW(A'+B'). Based on the same naming rule described above, the logic (A'+B') represents a logic combination of an inversion of logic A with an inversion of logic B, and the switch SW(A'+B') is set to be high while the logic A is low or the logic B is low. In comparison with the embodiments shown in FIG. 5 and FIG. 6, this combination shown in FIG. 7 provides a control method with less logic operators applied so the cost is reduced and the maintenance is simpler.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

The invention claimed is:

1. A method of operating a light emitting apparatus, comprising steps of:

providing a first light emitting device and a second light emitting device;

providing a first driving signal to the first light emitting device, wherein the first light emitting device emits a first light having a light characteristic within a first range;

sensing current which passes through the first light emitting device to generate a first sense signal;

sensing temperature around the first light emitting device to generate a second sense signal;

generating a second driving signal according to the first and the second sense signals;

providing a power source connecting to the second light emitting device and not connecting to the first light emitting device; and operating the second light emitting device to emit a second light by the second driving signal.

2. The method of operating a light emitting apparatus to claim 1, further comprising comparing the first sense signal with a first reference value and comparing the second sense signal with a second reference value, wherein the first reference value and/or the second reference value are fixed values or tunable values.

3. The method of operating a light emitting apparatus to claim 2, wherein the second light emitting device emits the second light when the first sense signal is less than the first reference value or the second sense signal is larger than the second reference value.

4. The method of operating a light emitting apparatus to claim 1, further comprising providing an amplifier circuit to modify the first sense signal.

5. The method of operating a light emitting apparatus to claim 1, wherein the first light emitting device comprises a first light-emitting diode emitting a blue light and a second light-emitting diode emitting a red light.

6. The method of operating a light emitting apparatus to claim 1, wherein the first light emitting device further comprises a wavelength converting element.

7. The method of operating a light emitting apparatus to claim 1, wherein the second light emitting device comprises a red light-emitting diode.

8. The method of operating a light emitting apparatus to claim 1, wherein the light characteristic comprises color temperature, light intensity, light field distribution, and light emitting period.

9. The method of operating a light emitting apparatus to claim 8, further comprising a mixture of the first light and the second light has the light characteristic within a second range and the light characteristic is color temperature and the difference between the first range and the second range is less than 300K.

* * * * *